United States Patent [19]

Boyle

[11] 3,999,895

[45] Dec. 28, 1976

[54] ROTATING BARREL PUMP

[76] Inventor: Bede Alfred Boyle, Rural Bank Chambers, Corner Hunter & Bolton Sts., 2300 Newcastle, New South Wales, Australia

[22] Filed: May 12, 1975

[21] Appl. No.: 576,878

Related U.S. Application Data

[63] Continuation of Ser. No. 310,000, Nov. 28, 1972, abandoned.

[30] Foreign Application Priority Data

Nov. 29, 1971 Australia ..... 7201/71

[52] U.S. Cl. ..... 417/271; 417/338; 417/342

[51] Int. Cl.[2] ..... F04B 1/00

[58] Field of Search ..... 417/225, 226, 227, 338, 417/342, 900, 271; 91/472, 487, 499, 485

[56] References Cited

UNITED STATES PATENTS

| | | | |
|---|---|---|---|
| 3,405,641 | 10/1968 | Coberly | 417/271 |
| 3,818,803 | 6/1974 | Scott et al. | 91/499 |

*Primary Examiner*—William L. Freeh
*Assistant Examiner*—G. P. LaPointe
*Attorney, Agent, or Firm*—Stevens, Davis, Miller & Mosher

[57] ABSTRACT

A positive displacement pump or motor having a plurality of cylinders in a rotatable cylinder block, the axes of the cylinders being parallel to the axis of rotation of the block, and stationary inlet and discharge ports which overlap openings in the cylinders so that port areas are constantly open to permit constant flow into the cylinders and constant flow out of the cylinders.

6 Claims, 3 Drawing Figures

ROTATING BARREL PUMP

This is a continuation of application Ser. No. 310,000 filed Nov. 28, 1972 now abandoned.

This invention relates to pumps and motors and more particularly to pumps adapted for the movement of slurries or mixtures of liquids and granular solids for pipeline transportation.

For example, in one application of the invention described herein the pump is adapted to transport materials such as coal, iron ore, limestone, wood chips and other granular solid substances. In the transportation of minerals it is an advantage to mix such materials with water or some other suitable liquid to form a so-called slurry because the fluid-like properties of the latter reduce the resistance of motion of solid materials when moving relatively to a stationary boundary or pipe wall.

It is an object of the present invention to permit movement of solids through pipelines over long distances while keeping the slurry free from pressure fluctuations.

Positive displacement pumps for slurry pipelining of solid materials have developed largely from the background of mud pumping as used in oilfield drilling. Present pumps for pipeline transportation over hundreds of miles are of crank driven piston and ram design. These pumps work directly on the slurry or some suitable liquid which contacts the slurry in a chamber, or else the pumping liquid is separated by a diaphragm from the slurry in a chamber. Another known system has chambers or hoppers in which the slurry is separated by a ball-like element from the pumped liquid.

In all the aforementioned prior art systems, pump cylinders and chambers are of course charged and discharged intermittently. Generally, pumps are of duplex or triplex configuration to reduce fluctuations in flow rate and usually a pneumatic damper is fitted to reduce pressure pulsations. In the chamber method, a sophisticated means of timing is necessary to control slurry discharge to the pipeline and hence reduce pressure fluctuations. Generally, positive displacement systems require valves which operate in slurry at a pressure of around 2000 psi. The poppet type valve with elastic seating has current widespread use in these systems but is not immune to abrasion from slurry.

It is a further object of the present invention to provide a positive displacement rotary pump which achieves:

1. constant flow rate and freedom from pressure pulsations, and
2. elimination of valve contact for slurry sealing by using a liquid sealed rotary valve.

According to the invention, therefore, a positive displacement pump or motor comprises a plurality of cylinders in a rotatable cylinder block, the axes of said cylinders being parallel to the axis of rotation of said block, and an arrangement of stationary inlets and discharge ports, which overlap openings in said cylinders so that port areas are constantly open to permit flow into said cylinders and out of said cylinders.

Pump operation is by hydraulic powered free pistons in the rotating cylinder block with cylinders overlapped by stationary inlet and discharge ports in a water lubricated and sealed rotary valve. This enables pressures up to 2500 psi with pulsation free constant pumping for long distance pipelines.

One particular embodiment of the invention defined in the preceding paragraph will now be described with reference to the accompanying drawings in which similar references indicate corresponding parts, and in which.

Figure 1:
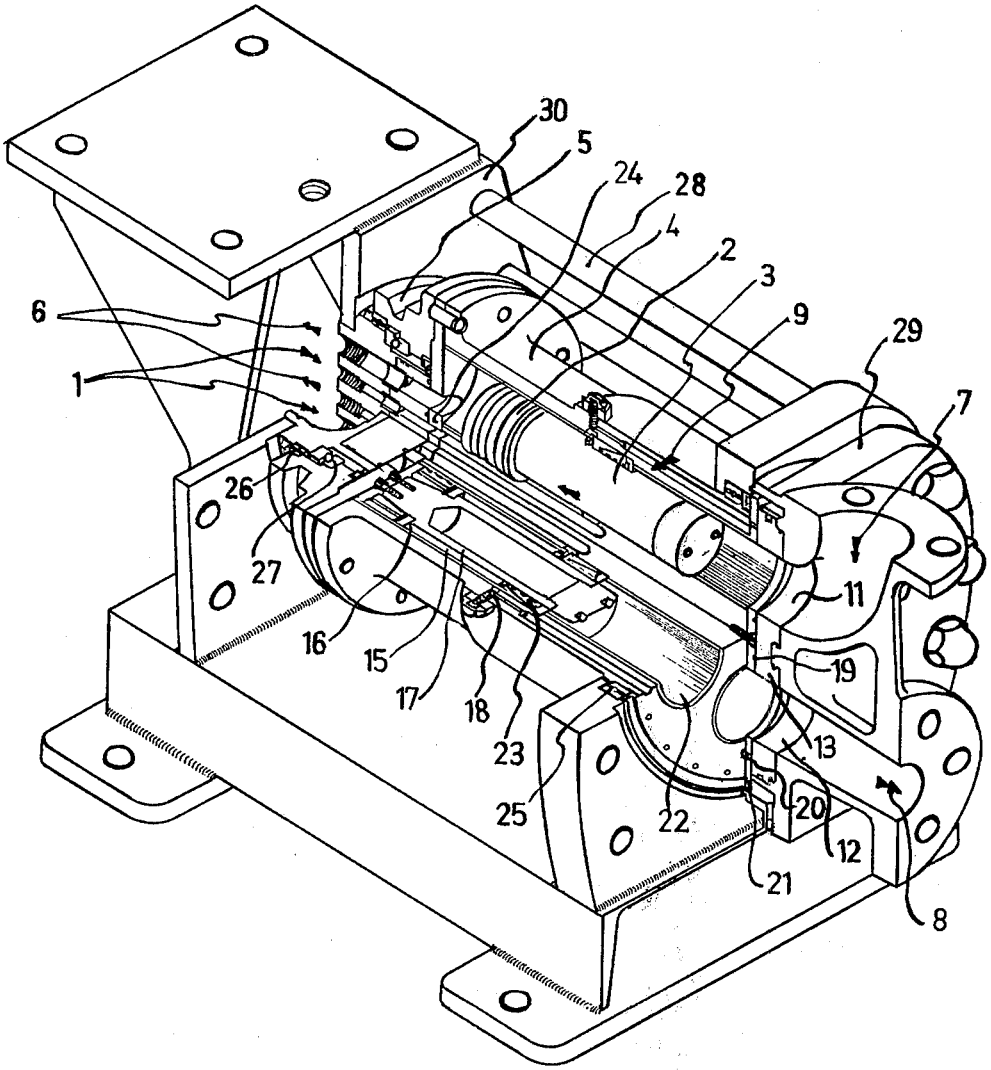
FIG. 1 shows said pump or motor in isometric view and having four cylinders.

Upon referring to the drawings it will be seen that said pump is typically a 2 inch pump having four cylinders. The pump is combined with a hydraulic motor which is powered by a separate high head water pump. A constant flow rate of water enters the motor-pump at 1, and with constant rotation in the sense 9 of the cylinder block 4 by means of drive pulley 5 there results double acting reciprocation of motor pistons e.g. 2 and pump rams or pistons e.g. 3 in their cylinders. Pump rotational speeds are low (40 RPM or so) to obtain suitable pipeline transportation velocities. Slurry 7 enters through a stationary inlet port 11 which overlaps cylinders as they sweep past the inlet port and are filled. Similarly slurry 8 is discharged at pressure through the port 12 from cylinders as they sweep past the discharge port.

Pulsation-free constant discharge of slurry from the pump results from:

1. constant flow rate of water at 1 powering the motor,
2. constant and uninterrupted total port opening for water entering at 1 and leaving at 6 the motor with proportioning of flow by individual cylinder port openings in ratio to total port opening so that ram velocities are determined by flow rate to individual cylinders and are therefore fixed in relation to pump rotation,
3. constant and uninterrupted port openings for slurry entering the pump at 7 and leaving at 8
4. constant rotational speed of the pump.

Motor supply pressure will be greater than slurry discharge pressure (by 50 psi or so) so as to:

1. enable generation of pressure in the annular spaces for sealing and lubrication,
2. satisfy stroking requirements and pumping power needs. For a pump of given geometry the variables in pump operation are rotational speed, pressure difference between the driving water and slurry discharge and the slurry feed pressure. Considering the feeding of cylinders with slurry first, there will be a critical pump speed at which cylinders will not be completely filled and cavitation may cause this. The other effect is that the pressure of driving water, if too low, may cause short stroking during slurry feeding and during slurry discharge to the pipeline. Calculations for a commercial size pipeline (e.g. 18 inch diameter with 6 ft/s slurry velocity) fed by two pumps, shows that pump rotational speed is around 40 rev/min and as a consequence of the low slurry velocity (5 ft/s maximum) in the pump, there should be no trouble with slurry feeding or shortstroking. Pump mechanical losses have been found to be low in tests leading to the invention, and pump volumetric efficiency neglecting leakage of water, has been found to be as high as 90%, based on slurry output and driving water use.

Figure 3:
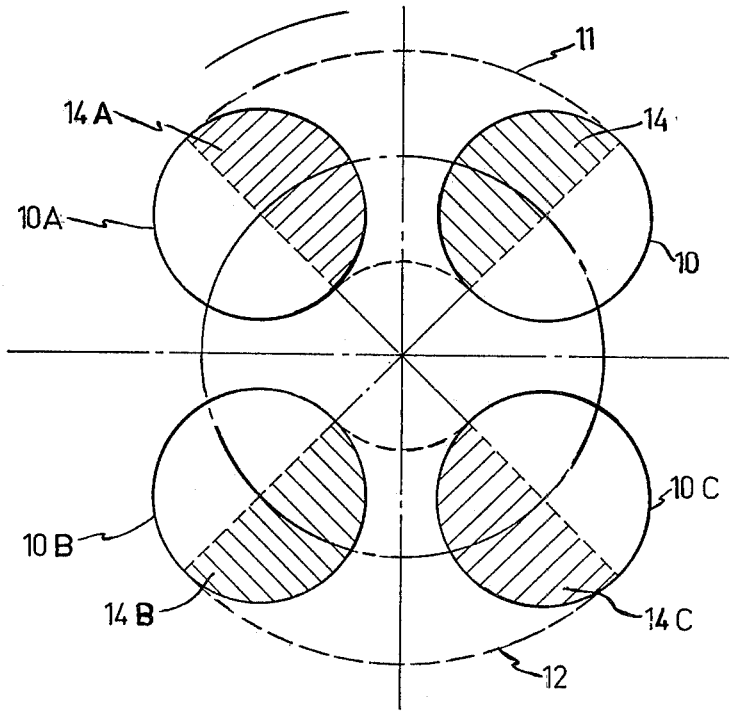
FIG. 3 shows schematically, in end elevation, a rotary valve on the pump cylinder block.

A liquid-sealed slurry valve consists of a stationary port plate 13 and a rotating valve plate 21 attached to the cylinder block 4. Upon referring to FIG. 3 it will be seen that circular areas 10, 10A, 10B and 10C are the slurry cylinder openings in the valve plate 21 and these are overlapped by the inlet and discharge ports 11 and 12. Two cylinders are half open each to the inlet port 11 and two cylinders are half open each to the discharge port 12. In all cylinder positions during pump rotation the total cylinder area open to the inlet port and to the discharge port (e.g. 14B + 14C) is equal to the cross sectional area of one cylinder and therefore there is no interruption to the flow of slurry in and out of the pump. This same principle is used to control the flow of driving water in and out of the motor cylinders so that flow rate of the slurry being pumped is constant. A minimum of three cylinders in combination with single inlet and discharge ports leads to the characteristics described above.

Sealing and lubrication of the rotary valve is by liquid film which separates the port plate 13 from the valve plate 21. As slurry is discharged from a cylinder, water is pumped from the annular space 15 between a motor cylinder e.g. 16 and pump ram e.g. 17. Valve 18 controls the flow of this water to the grooves 19 and 20 in the valve plate and thus provides pressurized lubrication. Also, slurry is prevented from clogging the clearance between the valve plate and port plate (0.002 inches or so as determined by back pressure on the port plate in its housing 13) and slurry is sealed in cylinders e.g. 22 which have been filled because the slurry pressure is always less than the water pressure on the valve plate. Additionally, water leaking through the clearance of the neck bush e.g. 23 lubricates and cleanses the rams during suction and discharge. The total leakage of water to slurry during pumping is tolerably small compared with the water content of commercially piped slurries and the initial water content of the slurry can be regulated to account for this.

External leakage from the periphery of the rotary valves depends on laminar flow of water in a parallel clearance space. One dimensional flow rate here is specified by, $$Q = \frac{1}{12\mu} \frac{\Delta p}{x} h^3 l \qquad (1)$$

where $h$ is the parallel clearance between the rotary valve and port plate, $x$ is the leakage path in the direction of flow, $l$ is the leakage boundary length normal to the flow, $\Delta p$ is the pressure drop across the leakage path and $\mu$ is absolute viscosity. As pumps vary in size the ratio $l/x$ can be made nearly constant so the external leakage rate remains reasonably constant, having regard to pump size. To reduce external leakage a pressure loaded seal ring (not shown) could be placed in the slurry port plate to seal against the valve plate.

The motor valve plate 24 is lubricated and sealed in similar fashion to the pump valve plate. Pump main bearings 25, 26 are loaded by weight of the cylinder block and thrust bearing 27 takes the imbalance of load on the pump valve plate and motor valve plate. Tie rods 28 withstand the separating force on the pump housing and pump frame elements 29 and 30.

Figure 2:
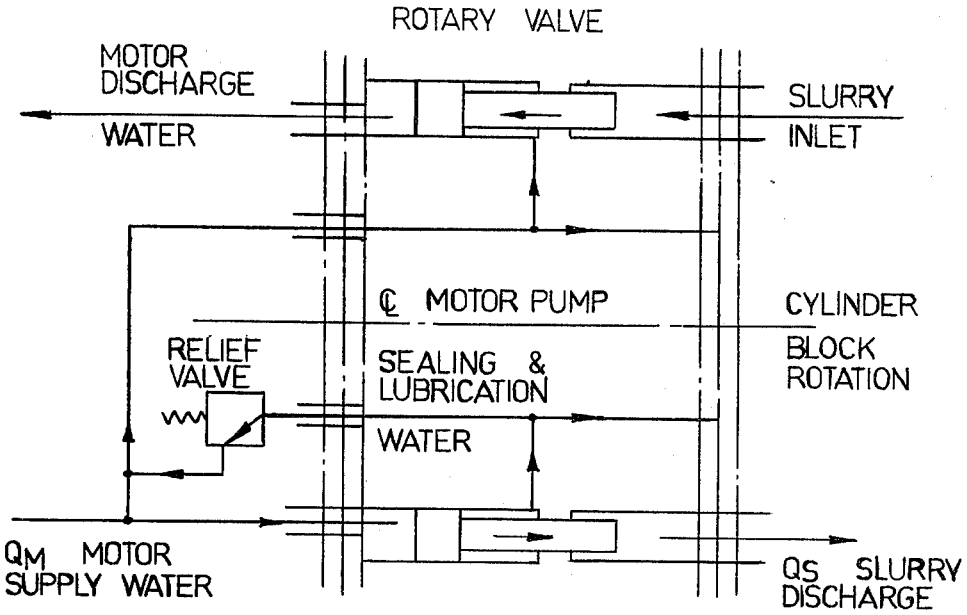
FIG. 2 is a schematic motor-pump circuit showing water and slurry flow paths for two of said cylinders.

A schematic motor-pump circuit in FIG. 2 shows water and slurry flow paths for two of the cylinders in the four cylinder pump.

The flow rate of slurry discharge is, $$Q_S = \frac{\pi}{4} n d^2 SN$$

where $n$ is the number of slurry rams
$d$ is slurry ram diameter
$S$ is slurry ram stroke
$N$ is pump rotational speed.

To obtain an average slurry velocity V in the pipeline discharged to, the pump speed is, $$N = \frac{V}{XnS} \left\{ \frac{d_p}{d} \right\}^2$$

where $d_p$ is the slurry pipeline diameter and X is the number of pumps discharging to the pipeline.

On small pipelines (up to 4 inches say) a single pumping unit may be adequate and with a ratio of ram to pipeline diameter $d/d_p = 1.5$, $d_p = 4$ inches, $S = 2d$, $n = 4$ and with $V = 6$ft/s, equation (3) then gives $N = 40$ rev/min.

For larger pipelines (up to 18 inches say) using two pumping units, one operating at fixed speed, the other variable for flow control, and with $\{d/d_p\}^2 = ½$, $d_p = 18$ inches, $S = 2d$, $n = 4$, $V = 6$ft/s and $X = 2$ then equation (3) gives, N = 42 rev/min.

Volumetric efficiency of the motor pump is given by, $$\eta VOL = Q_S/Q_M$$

where $Q_M$ is the volumetric flow rate of water powering the motor. When amounts of water for sealing and lubrication are disregarded, the efficiency becomes, $$\eta_{VOL} = \{d/d_m\}^2 \qquad (4)$$

where $d_m$ is motor cylinder diameter.

Volumetric efficiency is around 80% to 90% for pumps designed and used in tests leading to the invention. Mechanical efficiency of the motor-pump is high because of the low piston and ram velocities and low rotational speed.

I claim:

1. A positive displacement pump to provide pulsation free constant discharge of slurry, comprising:

a. a rotatable cylinder block;
b. means for rotating said cylinder block at a constant rotational speed;
c. a plurality of fluid power motor cylinders housed in said cylinder block;
d. first stationary inlet and discharge ports which overlap openings in said motor cylinders, said motor cylinders providing a constant and uninterrupted total port opening for fluid entering said first inlet port and leaving said first discharge port irrespective of the position of said cylinder block;
e. a plurality of fluid power pump cylinders housed in said cylinder block and equal in number to said motor cylinders, the axes of said motor and pump cylinders being parallel to the axis of rotation of said cylinder block;
f. second stationary inlet and discharge ports which overlap openings in said pump cylinders, said pump cylinders providing a constant and uninterrupted total port opening for slurry entering said second inlet port and leaving said second discharge port irrespective of the position of said cylinder block;

g. means, interconnecting said motor cylinders and said pump cylinders and having a reciprocating motion within said cylinder block, to ensure the entering and leaving of fluid and slurry in said motor and pump cylinders; and h. means providing a constant flow rate of fluid to drive said fluid power motor cylinders to effect a constant flow rate of slurry from said pump cylinders.

2. A positive displacement pump according to claim 1 wherein each one motor cylinder is axially aligned with each one pump cylinder, the cross-sectional area of each said one pump cylinder having a constant ratio to that of its corresponding axially aligned one motor cylinder.

3. A positive displacement pump according to claim 1 wherein said rotating means is connected externally of said cylinder block to said cylinder block to rotate said cylinder block.

4. A positive displacement pump according to claim 1 wherein said providing means introduces fluid into said motor cylinders from one end only of said cylinder block.

5. A positive displacement pump according to claim 1 wherein said second inlet and discharge ports are provided in a stationary port plate, and further comprising a rotating valve plate between said pump cylinders and said port plate, said valve plate having openings aligned with said pump cylinders, and means for supplying a portion of said fluid driving said motor cylinders to a space between said port plate and said valve plate to form a seal therebetween and lubricate said valve plate.

6. A positive displacement pump according to claim 2 wherein said interconnecting means for each axially aligned motor cylinder and pump cylinder comprises a ram.

* * * * *